US008967895B2

(12) United States Patent
Svendsen et al.

(10) Patent No.: US 8,967,895 B2
(45) Date of Patent: Mar. 3, 2015

(54) APPLICATION DEVICE FOR PRODUCTS

(75) Inventors: Siv-Rita Svendsen, Skien (NO); Lene Eriksen, Kragerø (NO)

(73) Assignee: Elecape AS, Skien (NO)

( * ) Notice: Subject to any disclaimer, the term of this patent is extended or adjusted under 35 U.S.C. 154(b) by 127 days.

(21) Appl. No.: 13/518,393

(22) PCT Filed: Dec. 22, 2010

(86) PCT No.: PCT/NO2010/000484

§ 371 (c)(1),
(2), (4) Date: Aug. 29, 2012

(87) PCT Pub. No.: WO2011/078694

PCT Pub. Date: Jun. 30, 2011

(65) Prior Publication Data

US 2012/0328353 A1 Dec. 27, 2012

(30) Foreign Application Priority Data

Dec. 22, 2009 (NO) ..... 20093578

(51) Int. Cl.
*A46B 11/00* (2006.01)
*A45D 34/04* (2006.01)

(52) U.S. Cl.
CPC ..... *A45D 34/045* (2013.01)
USPC ..... 401/127; 401/126; 132/218

(58) Field of Classification Search
CPC ..... A45D 34/045; A45D 40/265; A46B 11/00
USPC ..... 401/126–129
See application file for complete search history.

(56) References Cited

U.S. PATENT DOCUMENTS

| | | | | |
|---|---|---|---|---|
| 3,157,905 | A | 11/1964 | Levy | |
| 4,984,920 | A | 1/1991 | O'Neill | |
| 4,990,014 | A | 2/1991 | O'Neill | |
| 5,121,763 | A | 6/1992 | Kingsford | |
| 6,082,918 | A | 7/2000 | Gueret | |
| 6,309,125 | B1 * | 10/2001 | Peters | 401/127 |
| 6,773,186 | B1 * | 8/2004 | Shih | 401/129 |
| 6,883,990 | B2 * | 4/2005 | Shih | 401/127 |
| 7,465,113 | B2 * | 12/2008 | Gueret | 401/129 |
| 8,070,373 | B2 * | 12/2011 | Kim | 401/129 |
| 2005/0000849 | A1 | 1/2005 | Shih | |
| 2010/0098479 | A1 * | 4/2010 | Brantenaar et al. | 401/129 |

FOREIGN PATENT DOCUMENTS

| | | | |
|---|---|---|---|
| WO | WO 02/39845 | A | 5/2002 |
| WO | WO 2008/069666 | A | 6/2008 |

* cited by examiner

*Primary Examiner* — David Walczak
*Assistant Examiner* — Jennifer C Chiang
(74) *Attorney, Agent, or Firm* — Christian D. Abel

(57) ABSTRACT

The present invention relates to an application device (1) for a liquid or semi-liquid product contained in a receptacle (B), where the application device (1) comprises an adjusting screw (3), an applicator brush (2) and a sleeve (4). By means of the adjusting screw (3), the applicator brush's (2) position in the longitudinal direction of the sleeve (4) can be controlled, whereby the application device's (1) applicator element (21) is brought into contact with the liquid or semi-liquid product contained in the receptacle (B).

8 Claims, 7 Drawing Sheets

APPLICATION DEVICE FOR PRODUCTS

Figure 1:
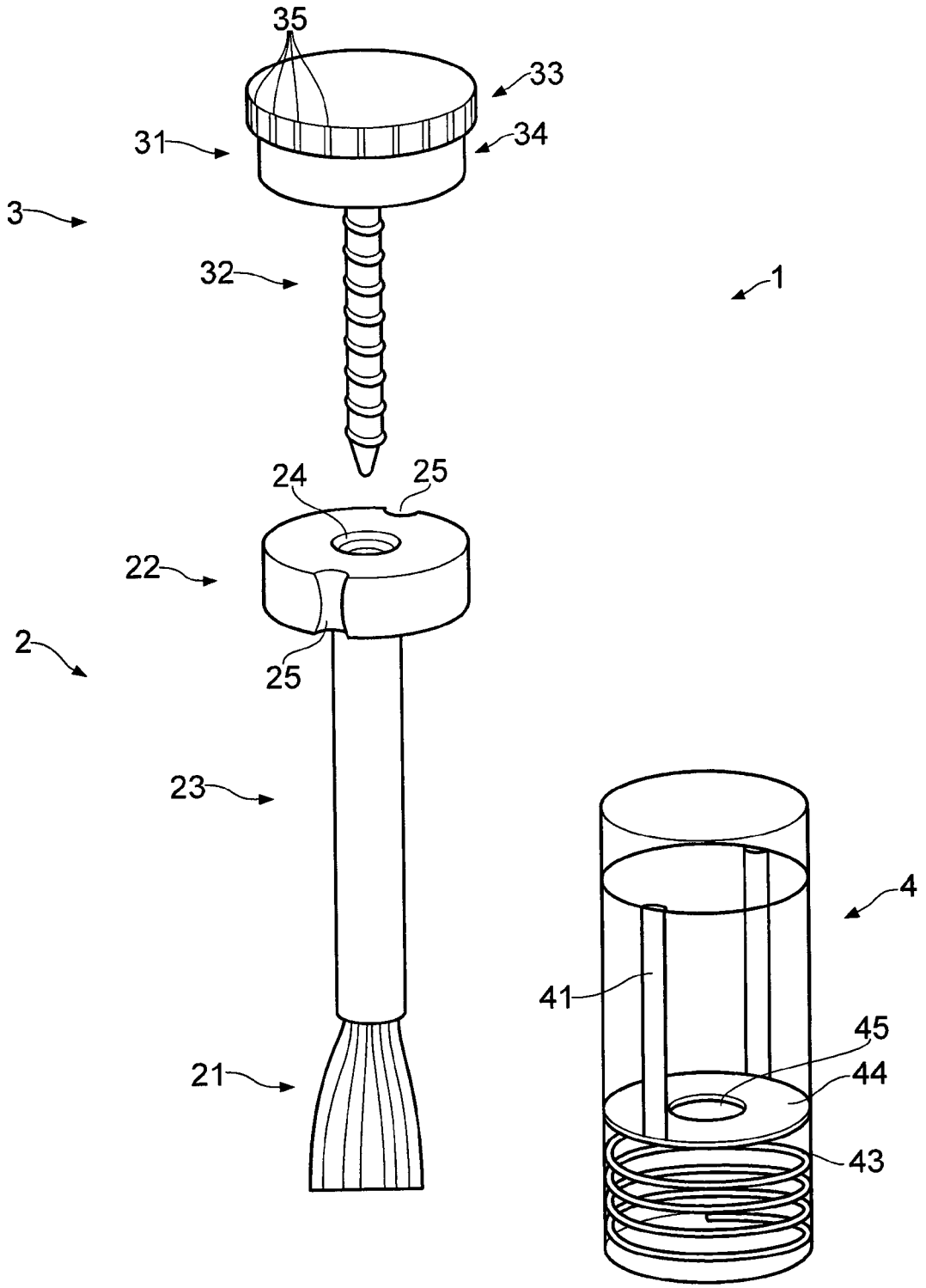

The present invention relates to an application device which is used for applying a product to a desired location or surface. More particularly, the present invention relates to an application device for liquid or semi-liquid products contained in a receptacle, where the application device is adjustable in its longitudinal direction.

Many liquid and semi-liquid products contained in a receptacle (bottle, tin, pail etc.) are applied to a desired location or surface by means of an applicator element. The applicator element is composed of a holder part and an applicator brush, where the applicator brush can accumulate and hold a certain quantity of the product contained in the receptacle. Here the applicator brush is adapted to suit the properties of the actual product. The product may, for example, be paint, glue, correction fluid, nail varnish, mascara, etc.

If the product is a cosmetic product, the applicator element may be in the form of a bundle of bristles forming a brush (for applying nail varnish), a fluffy filament or the like (for applying mascara, lip gloss etc.).

Examples of such applicator elements for cosmetic products are disclosed, for example, in U.S. Pat. No. 7,344,327, U.S. 2007/0140773 and U.S. 2008/0118298. The applicator elements are designed to be flexible, to enable them to absorb a quantity of the cosmetic product, etc.

U.S. Pat. No. 3,157,905, U.S. Pat. No. 5,121,763, WO 02/39845 and WO 2008/069666 describe applicator devices for a liquid or semi-liquid product contained in a receptacle, where the applicator device comprises an applicator brush which by means of an adjusting screw or cap can be adjusted in its longitudinal direction.

Receptacles and/or applicator elements for liquid or semi-liquid products, however, are very often designed in such a way that the applicator element cannot be used to absorb all of the product contained in the receptacle. The result is that a user will attempt to "open" the receptacle in order to remove the remainder of the product, or that the receptacle is discarded, even though a substantial amount of the product may be left in the receptacle.

The object of the present invention is to provide an application device for various products contained in a receptacle, where the applicator device can be extended, thereby enabling more of the liquid or semi-liquid product contained in a receptacle to be removed and applied to the desired location or surface.

Another object according to the present invention will be to provide an application device for a liquid or semi-liquid product contained in a receptacle, where the application device will permit a controlled uptake of the product contained in the receptacle.

These objects are achieved with an application device for liquid or semi-liquid products contained in a receptacle as indicated in the following independent claim, where further features of the invention will become apparent from the dependent claims and the description below.

The present invention relates to an application device for various products which are contained in a receptacle, where the application device comprises an adjusting screw, an applicator element and a sleeve, which when assembled can be screwed on to the receptacle containing a product. By means of the adjusting screw the applicator element will be able to be moved in the sleeve's longitudinal direction, with the result that by means of an extension the applicator element is brought into contact with the product contained in the receptacle.

The application device according to the present invention may be used for applying a liquid or semi-liquid product to a desired location or surface, where the product may, for example, be paint, glue, correction fluid or various cosmetic products such as nail varnish, mascara, lip gloss, etc.

The applicator element is composed of a stem, an applicator brush and a head part (holder part), where the applicator brush and the head part are arranged at each end of the stem. The applicator brush is adapted to suit the product with which it has to be used and may, for example, be a bundle of brush bristles if the application device is to be used for applying a nail varnish. In other cases, if the product has a more solid consistency, for example a cosmetic product such as mascara, the applicator brush may be made of a fluffy, downy or foamed (foamed plastic) material, which will be able to accumulate and hold a portion of the product.

However, a person skilled in the art will know how the applicator brush should be manufactured, and it will therefore not be further discussed here.

In an alternative embodiment of the present invention the applicator element may be manufactured without an applicator brush, in which case an end of the stem may act as an applicator brush. The stem may then be provided with a slightly wider tip, or the stem may be provided with a cavity extending a certain length inwards in the stem, with the result that the product which has to be applied attaches to the wider tip or is drawn into the stem by means of the capillary effect.

The applicator element is further connected to the stem at the opposite end of the head part, for example by gluing, clamping or the like.

The applicator brush may be manufactured in a single piece or be composed of several parts, for example the applicator brush's head part and stem may be produced as separate, discrete elements, whereupon they are assembled by means of a rapid coupling, screwing or gluing. The separate, discrete elements may furthermore be made of the same material or of different materials.

The applicator element's head part, which in an embodiment of the present invention has a circular shape, is provided with a threaded portion, where the threaded portion extends through the head part and a length into the applicator element's stem. The threads in the threaded portion are complementary in form to threads in the adjusting screw. Round the circumference of the applicator element's head part there is further provided at least one groove or recess, where in a preferred embodiment of the present invention the at least one groove or recess extends vertically in the applicator element's longitudinal direction. The at least one groove or recess will interact with one or more corresponding slide or guide grooves arranged on the inside of the sleeve, thereby preventing the applicator element from rotating internally in the sleeve when the applicator element is moved internally in the sleeve's longitudinal direction by means of the adjusting screw.

It should be understood, however, that the grooves or recesses in the applicator element's head part and the interacting slide or guide grooves in the sleeve may also be spiral-shaped, where this may be expedient, for example, for removal of an excess amount of product attached to the applicator element's stem. A stop and close device may then be arranged internally in the sleeve, whereby, by means of adjustment of the adjusting screw, the applicator element's stem will pass and simultaneously be rotated over or through the stop and close device, with the result that an excess amount of the liquid or semi-liquid product will be removed from the applicator element's stem.

In an embodiment of the present invention the head part of the applicator element has a circular shape and a diameter which is less than the diameter of a through bore in the sleeve.

It should be understood, however, that the applicator element's head part may also have other, polygonal or oval shapes. In an alternative embodiment of the present invention the applicator element's head part is oval-shaped, where the sleeve's through bore has a corresponding oval shape at least over a part of its length. This alternative embodiment has the result that the applicator element's head part and sleeve do not need to be provided with grooves or recesses and associated slide or guide grooves, since the oval shape will prevent the applicator element from rotating internally in the sleeve when the applicator element is moved internally in the sleeve's longitudinal direction by means of the adjusting screw.

The application device's adjusting screw is composed of a head part and a stem, where the stem is provided with external threads over a part or the whole of its length. The shape and size of the threads will be complementary to the threads in the applicator element's head portion, thereby enabling the adjusting screw's stem to be screwed into and unscrewed from the applicator element's head part.

In an embodiment of the present invention the threaded portion of the adjusting screw's stem may be interrupted by one or more portions without threads, for example at the stem's upper and lower ends, where this design will restrict the applicator element's axial movement in the receptacle.

A person skilled in the art will know how these threads should be designed, and it is therefore not discussed further here.

In an embodiment of the present invention the adjusting screw's head part is composed of an upper edge and a lower edge with different diameters, where in an embodiment of the present invention the upper edge may be provided with slots, grooves or the like round the whole or parts of its circumference, where this is intended to facilitate the handling of the adjusting screw. A material with a rough surface may furthermore be envisaged glued to the upper edge's circumference, the circumference may be decorated with stones or diamonds, etc. The lower edge of the adjusting screw will have a circular shape and a diameter which is less than the upper edge, where the diameter will substantially correspond to the diameter of the applicator element's head part. The diameter of the lower edge of the adjusting screw's head part and the applicator element's head part will therefore be less than the through bore in the application device's sleeve.

In an alternative embodiment of the present invention the application device is designed to be able to be integrated in an already existing receptacle's "cap", sleeve etc., whereby the adjusting screw's head part may then be provided with the same diameter over its entire length.

An alternative embodiment of the application device according to the present invention may be where the adjusting screw is provided with an internally threaded sleeve (instead of a threaded stem) and the head part of the applicator element with external threads, so that the adjusting screw is "screwed" in over the applicator element.

This will also result in a movement of the applicator element in the sleeve's longitudinal direction. In this case the applicator element's stem may instead be provided with at least one groove or recess, where this groove or grooves or recesses interact with a corresponding number of slide or guide grooves internally in the sleeve, thereby preventing the applicator element from following the adjusting screw's rotation when the applicator element in the application device has to be adjusted. In an embodiment the applicator element's stem may have a polygonal or oval shape, where a stop and close device, which is mounted inside the sleeve, will be provided with a corresponding polygonal or oval shape, thereby enabling the applicator element's stem to be moved up and down through the stop and close device. This embodiment of the applicator element's stem and stop and close device will prevent the applicator element from following the adjusting screw's rotation when it is employed for adjusting the applicator element, thereby enabling the applicator element to be adjusted.

The application device's sleeve is in the form of a circular and hollow sleeve (through bore), where one end of the sleeve is provided with a threaded internal portion extending a length into the sleeve's longitudinal direction. The threaded portion is designed to interact with a threaded portion provided on the receptacle containing a liquid or semi-liquid product, thereby enabling the sleeve to be screwed on to the receptacle's threaded portion. The stop and close device, which is mounted inside the sleeve and at the end of the threaded portion, will restrict the applicator element's travel in the sleeve, close and seal the receptacle when the application device is screwed on to the receptacle. The stop and close device, moreover, will scrape excess product from the applicator element's stem by means of an adjustment of the applicator element. At the end opposite the threaded portion, the sleeve is designed to be able to receive the applicator element's head part and the lower edge of the adjusting screw's head part.

Since the applicator element's applicator brush can be completely immersed in the product contained in the receptacle by means of adjustment of the applicator element, the applicator brush may have absorbed an excess amount of the product. A scraper device is therefore arranged inside the sleeve in connection with the stop and close device, where in a preferred embodiment of the application device, this scraper device is composed of at least one washer (for example an O-ring) or the like, which is connected in a suitable manner to the stop and close device. Thus when the applicator element is moved in the sleeve's longitudinal direction via a rotation of the adjusting screw, the applicator element's stem and the applicator brush will be moved relative to the scraper device, whereby the excess amount of product is removed by means of this movement.

The stop and close device according to the present invention is composed of at least one plate, where the plate is provided with a through hole in the centre. The hole is designed to permit the applicator element to be able to be moved through the hole, and may therefore be provided with a circular, polygonal, oval etc. shape, corresponding to the shape of the stem of the applicator brush. The stop and close device, which may be produced as a separate element and of a suitable material, will then be able to act as a scraper device for an excess amount of the liquid or semi-liquid product contained in the receptacle. Another type of scraper device will preferably be connected to the stop and close device, for example by providing an O-ring in the through hole in a suitable manner, by providing an O-ring between two plates etc. The use may, however, also be envisaged of a washer, in which case the washer will constitute both the stop and close device and the scraper device. The stop and close device is mounted inside the sleeve in a suitable manner, for example by gluing or welding.

Inside the sleeve there is further provided at least one slide or guide groove for grooves or recesses arranged in the applicator element's head part. This design will prevent the applicator element from following the adjusting screw's rotation when the adjusting screw has to be used to move the applicator element in the sleeve's longitudinal direction. In another possible embodiment of the application device according to the present invention the grooves or recesses in the applicator element's head part and the slide or guide grooves in the sleeve are designed to extend vertically in the applicator device's longitudinal direction, but it is also conceivable that the slide or guide grooves in the sleeve may be helical or spiral-shaped, whereby the applicator element is also subjected to a rotating movement during its axial travel. This may be expedient, for example, for removing an excess amount of product applied to the stem of the applicator element, since the applicator element is then in addition subjected to a rotating motion over the scraper device.

In a preferred embodiment of the present invention the sleeve is manufactured in a single piece. The sleeve, however, may also be envisaged made from several separate and individually manufactured elements, where, when they are assembled in a suitable manner, the separate, individual elements will form the application device's sleeve. For example, such an alternative embodiment of the sleeve may consist of two separate, individual elements, where one element (an upper part) may be provided with at least one slide or guide groove on the inside, where as described above, these are intended to interact with grooves or recesses arranged in the applicator element's head part. The stop and close device may also be mounted in this element. As mentioned above, the stop and close device will seal and close the receptacle when the sleeve is screwed on to the receptacle, in addition to restricting the applicator element's travel in the sleeve's longitudinal direction. If a scraper device is mounted in the sleeve, and for example connected to the stop and close device, the scraper device will remove an excess amount of a product from the applicator element's stem.

The second element (a lower part) in the sleeve will then be designed with an internally threaded portion, thereby enabling this element to be screwed on to the receptacle containing the product. The two separate and individually manufactured elements can then be assembled by means of gluing, various fastening devices, threads or the like to form the application device's sleeve. The manufacture of the sleeve in several separate elements may be expedient when the application device according to the present invention is to be used on already existing receptacles.

In an alternative embodiment of the application device according to the present invention the adjusting screw may be provided with a through hole with a countersunk portion, in which countersunk portion a head of a threaded bolt is arranged. The applicator element will then be provided in a similar manner with a through hole with a countersunk portion, in which countersunk portion a nut is arranged. The adjusting screw and the applicator element will therefore be interconnected via the bolt and nut connection, whereby the applicator element can be moved internally in the sleeve's longitudinal direction by means of the adjusting screw. In order to prevent the applicator element from rotating in the sleeve when the adjusting screw is employed for adjusting the applicator element's position in the sleeve, the applicator element may be provided with an oval or polygonal head part, in which case the sleeve will be provided with a bore over the whole or parts of its longitudinal direction, which bore has the same oval or polygonal shape as the head part.

Figure 2:
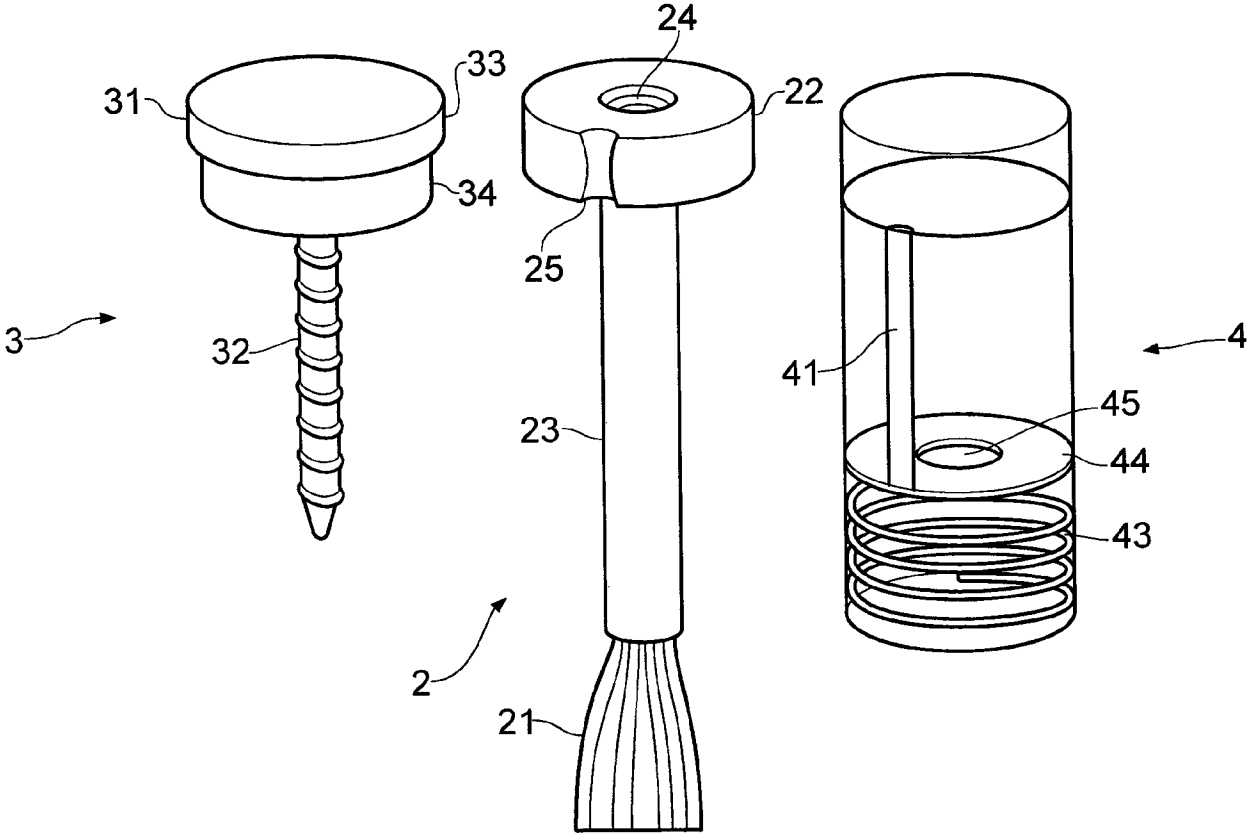
Figure 3:
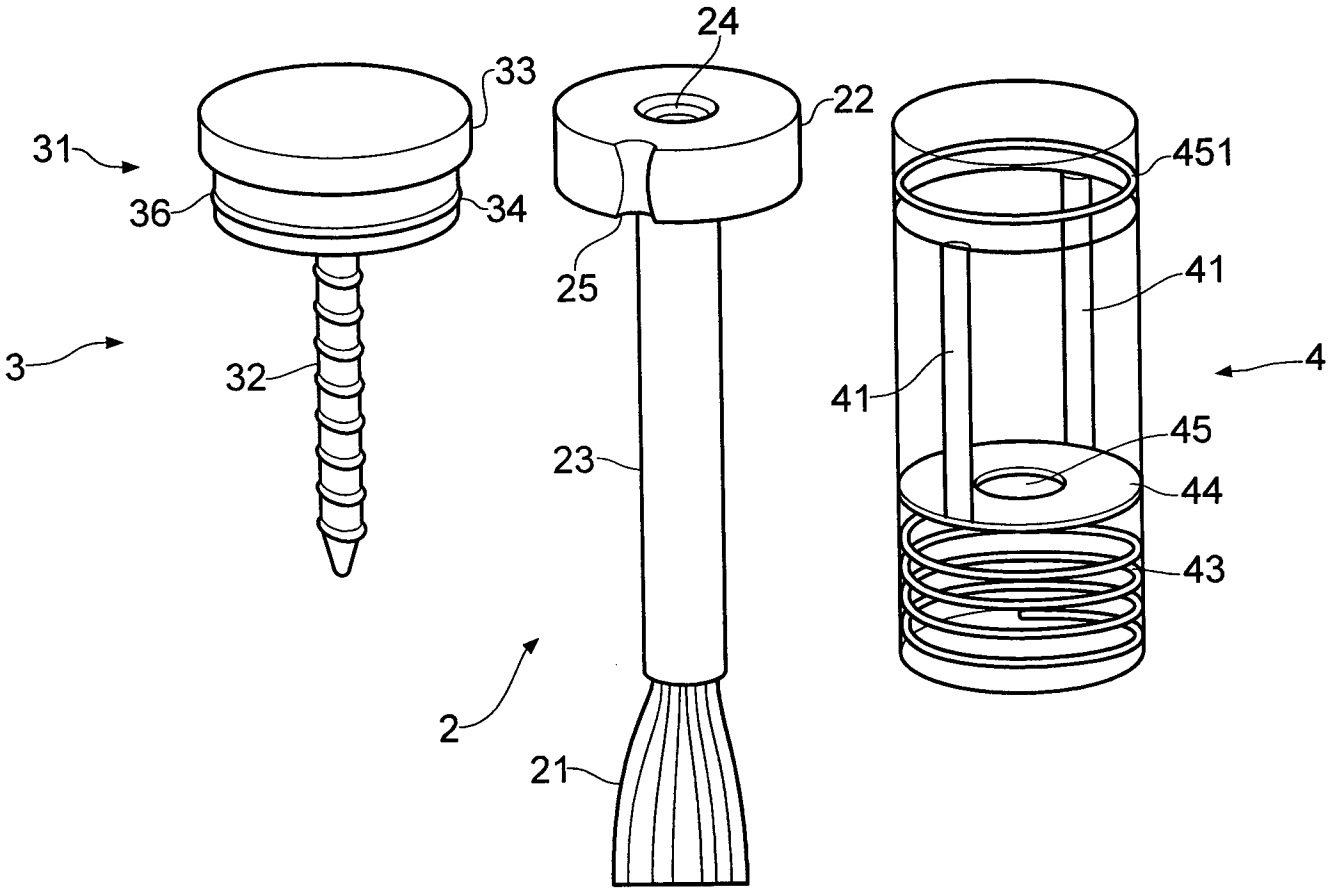
Figure 4:
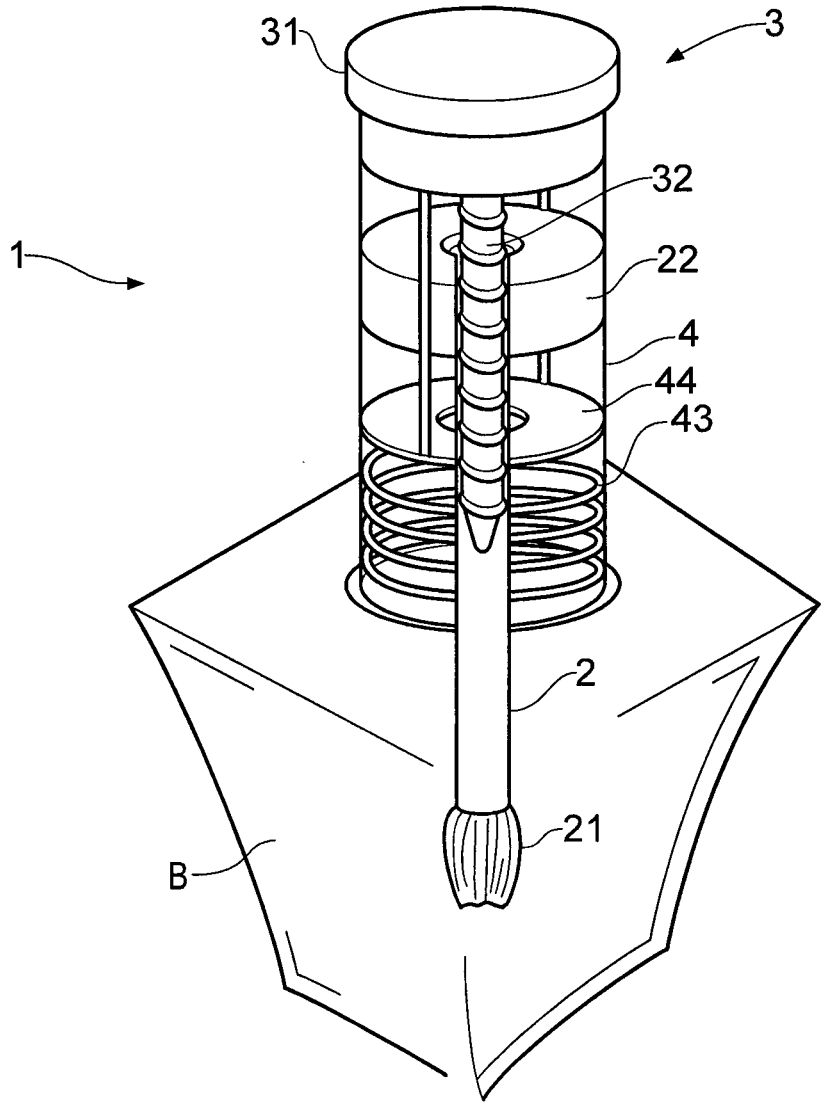
Figure 5:
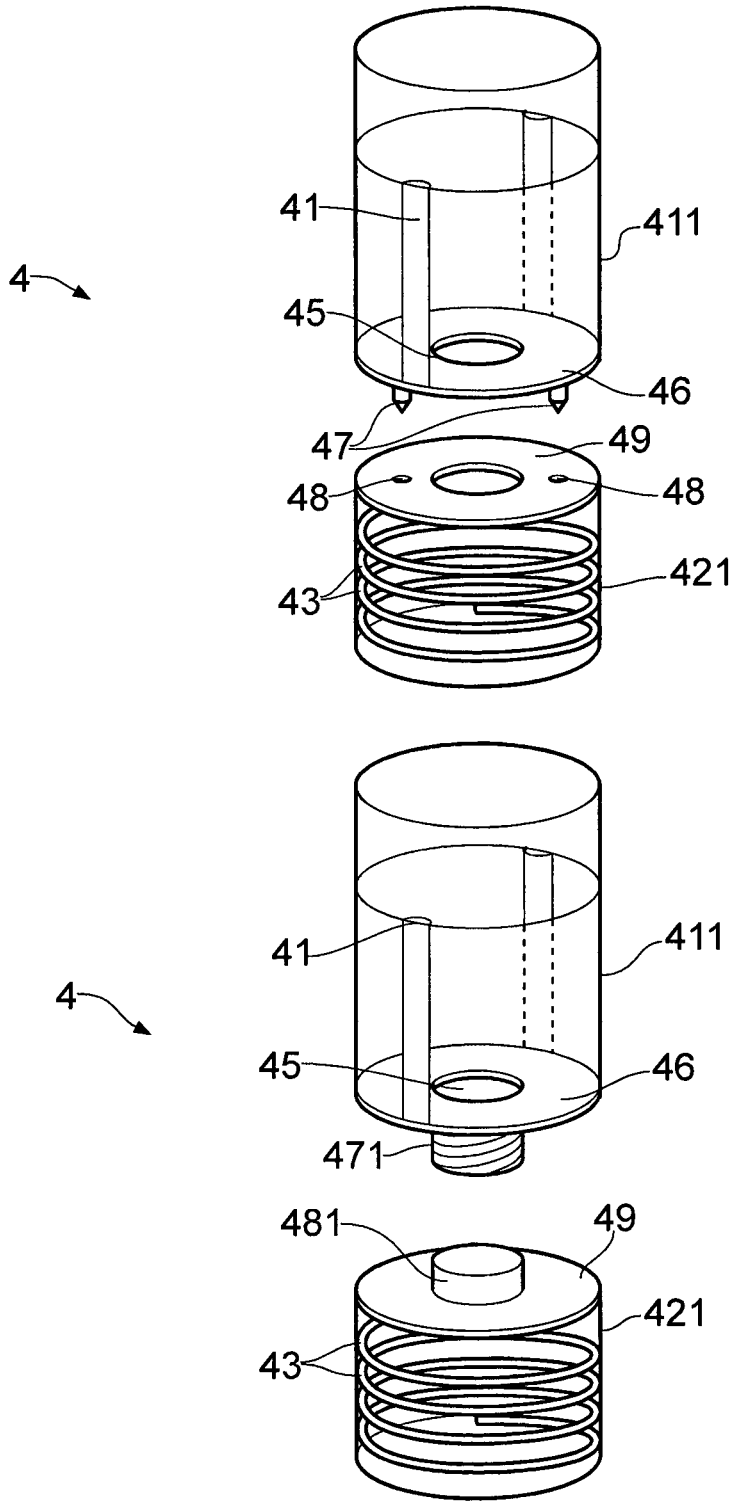
Figure 7:
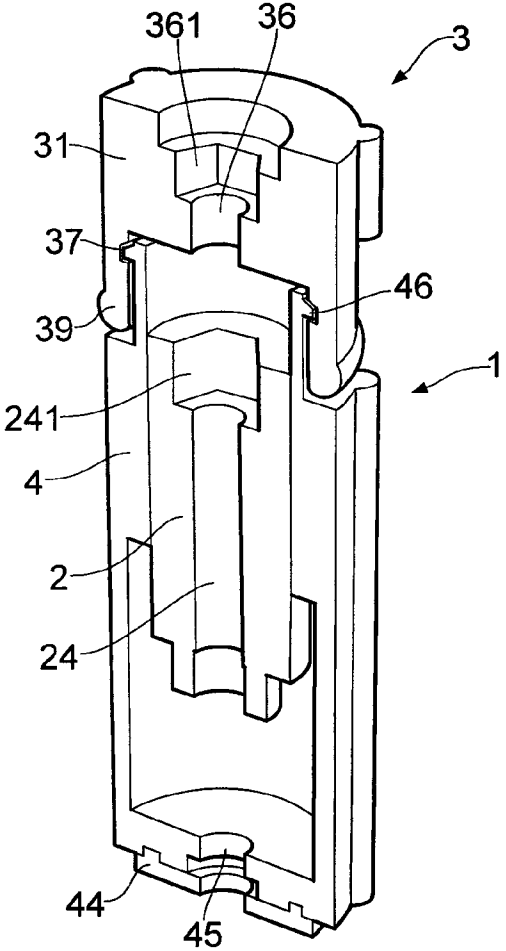
Figure 6:
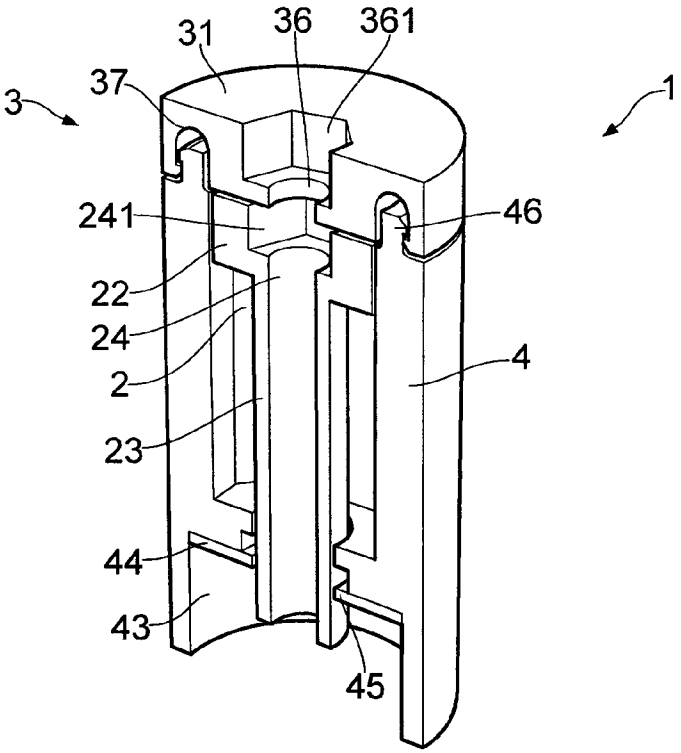
Figure 8:
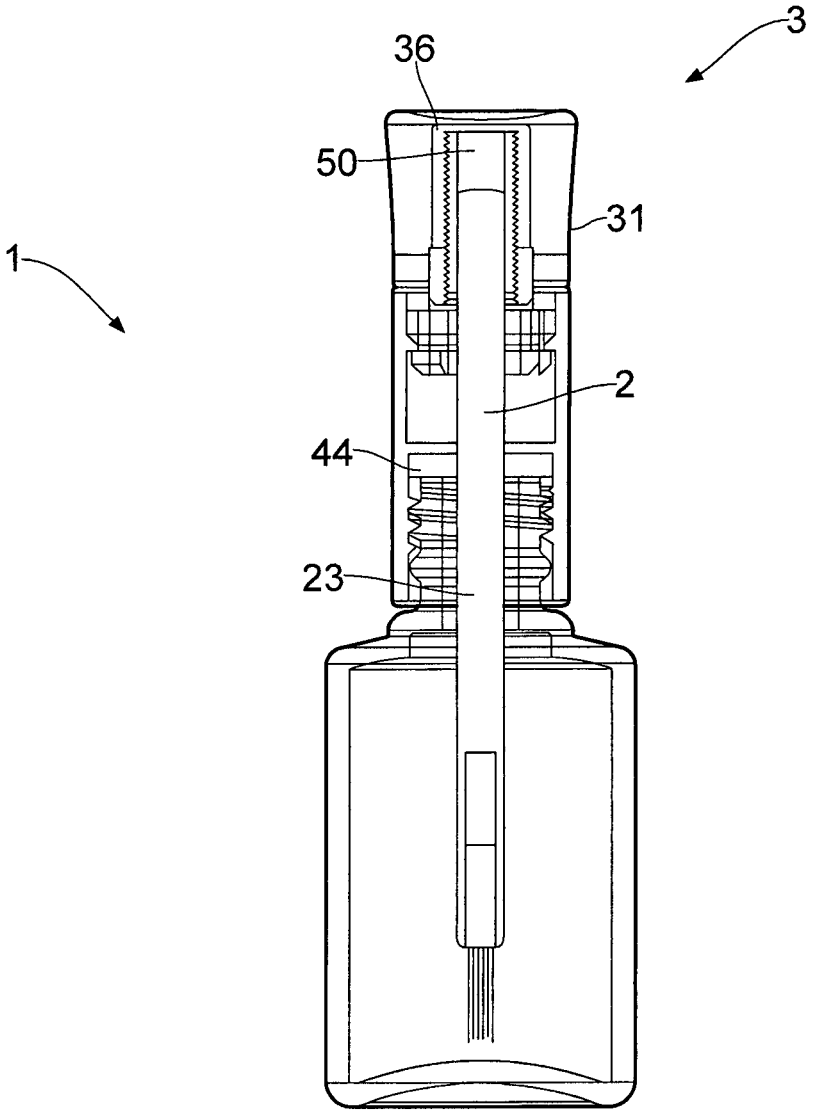

The invention will now be explained in connection with several embodiments and with reference to the attached figures in which;

FIG. 1 illustrates an embodiment of an application device according to the present invention, FIG. 2 illustrates a second embodiment of the application device according to the present invention, FIG. 3 illustrates a further embodiment of the application device according to the present invention, FIG. 4 illustrates the application device according to the present invention screwed on to a receptacle containing a liquid or semi-liquid product, FIG. 5 illustrates further embodiments of a sleeve for the application device, and FIGS. 6-8 illustrate three alternative embodiments of the application device according to the present invention.

FIG. 1 illustrates a first embodiment of an application device 1 for a liquid or semi-liquid product according to the present invention, where the liquid or semi-liquid product is contained in a receptacle B. The application device 1 is composed of an applicator element 2, an adjusting screw 3 and a sleeve 4. The applicator element 2 comprises an applicator brush 21 and a head part 22, where these are connected via a stem 23. In the illustrated embodiment the applicator brush 21 is in the form of a brush, consisting of a bundle of brush bristles connected to the stem 23 in a suitable manner. The applicator element's 2 head part 22 is provided in the centre with a through hole and a threaded portion 24, where the threaded portion 24 may also extend a length into the stem's 23 longitudinal direction. Round the circumference of the head part 22 are provided two grooves or recesses 25, where these extend vertically in the applicator element's 2 longitudinal direction. The grooves or recesses 25 will interact with corresponding slide or guide grooves 41 arranged on the inside of the sleeve 4, thereby preventing the applicator element 2 from rotating in the sleeve 4 when the adjusting screw 3 is used for adjusting the applicator element's 2 position in the application device's 1 longitudinal direction. In the illustrated embodiment the grooves or recesses 25 are arranged diametrically above one another.

The applicator element 2, i.e. the head part 22 and the stem 23, can be manufactured in a single piece, or it may be made from a separate head part 22 and a separate stem 23, which are interconnected in a suitable manner, for example by gluing, screwing or the like. The applicator brush 21 will then be connected to the stem 23, opposite the head part 22 in a suitable manner, for example by gluing, welding etc.

The adjusting screw 3 in the application device 1 also comprises a head part 31 and an externally threaded stem 32, where the threaded stem 32 is designed to interact with the threaded portion 24 in the applicator element 2. In this way the adjusting screw 3 can be employed for moving the applicator element 2 in the sleeve's 4 longitudinal direction. The adjusting screw's 3 head part 31 is composed of an upper edge 33 and a lower edge 34, where the upper edge 33 is provided around its circumference with slots, grooves 35 or the like, thereby facilitating the handling of the adjusting screw 3. The lower edge 34 of the adjusting screw 3 will have a diameter which substantially corresponds to the sleeve's 4 internal bore, with the result that, when the adjusting screw 3, the applicator element 2 and the sleeve 4 are assembled, the adjusting screw 3 with its upper and lower edges 33, 34 will form a closed and sealed end termination of one end of the sleeve 4.

The sleeve 4 is in the form of a circular and hollow cylinder (through bore), where two diametrically arranged slide or guide grooves 41 for the applicator element's 2 grooves or recesses 25 are provided on the inside of the sleeve 4. The sleeve 4, moreover, is provided at one end with a threaded portion 43, which threaded portion 43 extends a distance into the sleeve's 4 longitudinal direction. This threaded portion 43 interacts with threads which are provided in the receptacle's B "neck" (see also FIG. 4), thereby enabling the sleeve 4 to be screwed on to the receptacle B when the product is not being used. Internally in the sleeve 4 there is also provided a stop and close device 44, where the stop and close device 44 is in the form of at least one plate provided with a through hole 45, which plate serves the purpose of stopping the applicator element's 2 travel in the sleeve 4 and closing and sealing a receptacle B when the sleeve 4 is screwed on to the receptacle B. The stop and close device 44 may also comprise a scraper device (not shown) for the applicator element's 2 stem 23, which scraper device may then be mounted between two plates which form the stop and close device 44. The stop and close device 44 is furthermore arranged in the area between the slide or guide grooves 41 and the threaded portion 43.

In FIG. 2 a second embodiment of the application device 1 according to the present invention is illustrated, where the applicator element's 2 head part 22 is provided with only one groove or recess 25, whereby only one slide or guide groove 41 is also thereby provided in the sleeve 4.

The adjusting screw's 3 head part 31, i.e. the upper edge 33 of the head part 31, in this case is not provided with slots or grooves, but with a rough surface (not shown), thereby enabling the user to easily rotate the adjusting screw 3 when it is employed for adjusting the length of the applicator element 2.

Otherwise the application device 1 is designed as described according to the embodiment as illustrated in FIG. 1, and therefore no further description is given of the remaining elements of the application device 1.

FIG. 3 shows that the adjusting screw 3 is provided with a bead 36 in the lower edge 34 of the head part 31. When the adjusting screw 3 and the applicator element 2 are screwed together and arranged in the sleeve 4, the bead 36 will be disposed in a complementarily formed recess 451 on the inside of the sleeve 4. The bead 36 will permit the adjusting screw 3 to rotate in the sleeve 4, in order thereby to adjust the applicator element 2, while at the same time preventing the adjusting screw 3 and the applicator element 2 from inadvertently being separated from the sleeve 4. The bead 36 and the recess 451 are designed in such a manner that a force must be employed in order to join or separate them.

FIG. 4 illustrates an application device 1 screwed on to a receptacle B containing a liquid or semi-liquid product. The adjusting screw 3 is screwed into the applicator element's 2 head part 22 via the threaded stem 32. The adjusting screw 3 and the applicator element 2 are then pushed into the sleeve 4, whereupon the sleeve 4 is screwed on to the receptacle B via the threaded portion 43. When the sleeve 4 is screwed on to the receptacle B, the stop and close device 44 will abut against a neck of the receptacle B, thereby sealing and closing the receptacle B.

In FIG. 5 two embodiments of the application device's 1 sleeve 4 are illustrated, where it can be seen that according to a first alternative solution the sleeve 4 is made from two separate, individual elements 411, 421. Element 411 (upper part of the sleeve 4) is provided with two diametrically arranged slide or guide grooves 41 for the applicator element's 2 grooves or recesses 25. Furthermore, at an end facing element 421 (lower part of the sleeve 4), element 411 is closed by a plate 46, which plate 46 is provided with a through hole 45. Two pins 47 are mounted on a side of the plate 46 which is facing down towards the element 421, where these pins 47 are "clicked" into holes 48 arranged in a plate 49 in the element 421. In this fashion the elements 411, 421 are assembled to form the application device's 1 sleeve 4. The element 421 is furthermore provided with a threaded portion 43, which threaded portion 43 extends to the plate 49.

According to a second alternative solution the sleeve 4 is also made from two separate and individual elements 411, 421, and in a similar manner to the first alternative solution will comprise two diametrically arranged slide or guide grooves 41, a threaded portion 43 and plates 46, 49, but the plate 46 will now be provided with an externally threaded pin 471, where the externally threaded pin 471 has to be screwed into an internally threaded pin 481 provided in the plate 49 of the element 421.

The two above-described embodiments of the sleeve 4 may be appropriate if the application device 1 according to the present invention is to be integrated in an already existing receptacle.

In FIGS. 6 and 7 two further embodiments are illustrated of the application device 1 according to the present invention. In order to facilitate understanding of how the application device 1 is assembled, some elements are not illustrated in the figures.

FIG. 6 illustrates an application device 1 comprising an adjusting screw 3, where the adjusting screw is provided with a head portion 31. In the head portion 31 there is provided a through hole 36 with a countersunk portion 361, in which countersunk portion 361 of the through hole 36 a head of a threaded bolt (not shown) is arranged. The applicator element 2 will be provided in a similar manner with a through hole 24 with a countersunk head portion 241, in which countersunk head portion 241 a threaded nut (not shown) is arranged. The adjusting screw 3 and the applicator element 2 will therefore be connected by the bolt and nut connection. The threaded bolt will therefore serve the same purpose as the threaded stem 32 in the adjusting screw 3 according to FIG. 1, while the threaded nut will serve the same purpose as the threaded portion 24 in the applicator element 2 according to FIG. 1.

In order to prevent the applicator element 2 from rotating in a sleeve 4 when the adjusting screw 3 is employed for adjusting the applicator element's 2 position in the sleeve 4, the applicator element 2 is provided with an oval or polygonal head part 22. The sleeve 4 is then provided internally with a bore over the whole or parts of its longitudinal direction, where the bore has the same oval or polygonal shape as the head part 22.

The adjusting screw's 3 head portion 31 is provided round its lower edge with a recess 37, where this recess interacts with a bead 46 arranged round the sleeve's 4 upper edge. The recess 37 and bead 46 are of such a nature that a certain amount of force must be employed in order to join them together and separate them.

Furthermore, in its lower edge the sleeve 4 will be provided with a threaded portion 43, where a stop and seal device 44 is arranged at the end of this threaded portion 43. The stop and seal device 44 is provided with a through hole 45 (see also FIG. 1), and is composed of two plates, where between these two plates a scraper device (not shown) is mounted for the applicator element's 2 stem 23. The scraper device may, for example, be in the form of an O-ring, where this is "centred" relative to the plates' through hole 45. The stop and seal device 44 is connected in a suitable manner to the inside of the sleeve 4.

For the sake of simplicity the applicator element 2 is not illustrated provided with an applicator brush 21 (see also FIG. 1), but it should be understood that applicator brush 21 will be mounted at an end of the applicator element 2 which is opposite the head portion 31.

The application device's 1 mode of operation will otherwise be the same as described above by means of the other embodiments.

In FIG. 7 the application device 1 is designed to be able to be integrated into already existing receptacles' "cap", sleeve etc. The application device 1 consists of an adjusting screw 3, an applicator element 2 and a sleeve 4. The adjusting screw's 3 head portion 31 is provided with a through hole 36 with a countersunk portion 361, in which countersunk portion 361 of the through hole 36 a head of a threaded bolt (not shown) is mounted. On the inside of the head portion 31, moreover, a bore 39 is arranged which extends a length into the adjusting screw 3. Round its circumference the bore 39 is provided with a recess 37, where the recess 37 is intended to interact with a bead 46 arranged on an upper portion of the sleeve 4, thereby forming a "snap connection" between them.

In the same way as the adjusting screw 3, the applicator element 2 will be provided with a through hole 24 with a countersunk portion 241, in which countersunk portion 241 a threaded nut (not shown) is mounted. The adjusting screw 3 and the applicator element 2 will therefore be connected by the bolt and nut connection. The threaded bolt will therefore serve the same purpose as the threaded stem 32 in the adjusting screw 3 according to FIG. 1, while the threaded nut will serve the same purpose as the threaded portion 24 in the applicator element 2 according to FIG. 1.

In order to prevent the applicator element 2 from rotating in the sleeve 4 when the adjusting screw 3 is employed for adjusting the applicator element's 2 position in the sleeve 4, the applicator element is designed with an oval or polygonal shape. The sleeve 4 is then provided internally with a bore over the whole or parts of its longitudinal direction, where the bore has the same oval or polygonal shape as the applicator element 2.

In a lower edge, i.e. the edge which is nearest the receptacle B when the application device 1 is screwed on to it, the sleeve 4 will comprise a stop and seal device 44. The stop and seal device 44 is composed of at least one plate which is provided with a through hole 45 in its centre, and will serve the purpose of restricting the applicator element's 2 travel in the sleeve 4, as well as sealing the receptacle B when the application device 1 is screwed on to it. In addition, a scraper device may be attached to the stop and seal device 44, for example as described in the embodiment above.

For the sake of simplicity the applicator element 2 is not illustrated provided with an applicator brush 21 (see also FIG. 1), but it should be understood that applicator brush 21 with an extended stem will be arranged at an end of the applicator element 2 which is opposite the head portion 31.

The application device's 1 mode of operation will otherwise be the same as described above by means of the other embodiments.

When the application device 1 according to FIG. 7 is assembled, the application device 1 will be integrated into an already existing "cap", sleeve etc. on a receptacle B.

In FIG. 8 a further embodiment of the application device 1 according to the present invention is illustrated, where the application device 1 comprises an adjusting screw 3 with a head portion 31. In the head portion 31 there is provided a through hole 36 with threads. A sleeve 50 will be connected in a suitable manner to an end of the applicator element 2. The sleeve 50 is threaded externally, where the sleeve's 50 threads are complementary in shape to the threads in the adjusting screw's 3 through hole 36. The applicator element's 2 stem 23 has a polygonal shape. The stop and close device 44, in the form of a washer, is provided with a through hole in the centre, where this hole is provided with the same polygonal shape as the applicator element's stem 23. When the adjusting screw 3 is employed for adjusting the applicator element's 2 position in the receptacle, on account of its polygonal shape, the applicator element's 2 stem 23 will be prevented by the stop and close device from following the adjusting screw's 3 rotation, thereby enabling the applicator element to be moved in the receptacle's longitudinal direction.

The application device's 1 mode of operation will otherwise be the same as described above by means of the other embodiments.

The invention has now been explained with reference to several embodiments. A person skilled in the art will appreciate that several changes and modifications may be made to the illustrated embodiments which are within the scope of the invention as defined in the following claims. The adjusting screw's upper edge and the sleeve, for example, may have a square or other suitable shape, while the adjusting screw's lower edge and the through bore in the cap may have a circular shape, thereby permitting the adjusting screw to rotate internally in the cap when the applicator brush's "length" has to be adjusted. Furthermore, it should be understood that the applicator element's applicator brush will have to be adapted to suit the product with which the application device is to be used.

The invention claimed is:

1. An application device for a liquid or semi-liquid product contained in a receptacle, where the application device comprises an applicator element, an adjustment screw and at least one sleeve, the applicator element being movable in the at least one sleeve's longitudinal direction by employment of the adjustment screw, thereby bringing an applicator brush of the applicator element into contact with the liquid or semi-liquid product contained in the receptacle, wherein the applicator element is provided with a threaded portion extending through a head part and a length into an applicator element stem's longitudinal direction, for interaction with the adjustment screw provided with an externally threaded stem, the head part and the stem of the applicator element further being provided with an oval or polygonal shape, where a sleeve's through bore has a corresponding oval or polygonal shape of said through bore at least over a part of said sleeve's length, where a stop and close device, which is mounted inside the sleeve, will be provided with a corresponding shape of the stem of the applicator element, the oval or polygonal shape preventing the applicator element to rotate when the adjustment screw is employed for adjustment of the applicator element.

2. An application device according to claim 1, wherein the adjusting screw comprises a head part, which is composed of an upper and lower edge.

3. An application device according to claim 2, wherein the upper edge in the adjusting screw's head part is provided with slots, grooves or the like.

4. An application device according to claim 3, wherein the upper edge in the adjusting screw's head part is circular, square or polygonal, while the lower edge is circular.

5. An application device according to claim 4, wherein in the lower edge is mounted at least one sealing device.

6. An application device according to claim 1, wherein the applicator brush in the applicator element is composed of a bundle of brush bristles, a fluffy material or the like.

7. An application device according to claim 1, wherein the application device further comprises a stop and close device.

8. An application device according to claim 1, wherein at least one recess is arranged near an end of the sleeve, which end is the opposite end of a threaded portion.

* * * * *